US005826224A

United States Patent [19]

Gerson et al.

[11] Patent Number: 5,826,224

[45] **Date of Patent: *Oct. 20, 1998**

[54] METHOD OF STORING REFLECTION COEFFIENTS IN A VECTOR QUANTIZER FOR A SPEECH CODER TO PROVIDE REDUCED STORAGE REQUIREMENTS

[75] Inventors: Ira A. Gerson, Schaumburg; Mark A. Jasiuk, Chicago; Matthew A. Hartman, Schaumburg, all of Ill.

[73] Assignee: Motorola, Inc., Schaumburg, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 609,027

[22] Filed: Feb. 29, 1996

Related U.S. Application Data

[62] Division of Ser. No. 37,793, Mar. 26, 1993, abandoned.

[51] Int. Cl.[6] ..... G10L 9/14; G10L 9/08

[52] U.S. Cl. ..... 704/222; 704/217; 704/219

[58] Field of Search ..... 395/2.25–2.32, 395/2.28, 2.29; 704/216–223

[56] References Cited

U.S. PATENT DOCUMENTS

| | | | |
|---|---|---|---|
| 4,544,919 | 10/1985 | Gerson | 341/75 |
| 4,896,361 | 1/1990 | Gerson | 395/2.31 |
| 4,965,789 | 10/1990 | Bottau et al. | 370/465 |
| 4,975,956 | 12/1990 | Liu et al. | 395/2.31 |
| 5,012,518 | 4/1991 | Liu et al. | 395/2.28 |
| 5,038,377 | 8/1991 | Kihara et al. | 395/2.77 |
| 5,295,224 | 3/1994 | Makamura et al. | 395/2.32 |
| 5,307,460 | 4/1994 | Garten | 395/2.28 |
| 5,351,338 | 9/1994 | Wigren | 395/2.28 |

OTHER PUBLICATIONS

Furui, Sadaoki, Digital Speech Processing, Synthesis, and Recognition, 1989, New York, NY, pp. 118–119.

Rabiner and Schafer, Digital Processing of Speech Signals, 1978, by Bell Laboratories, Inc., USA, p. 452.

R. Viswanathan et al., "Quantization Properties of Transmission Parameters in Linear Predictive Systems," *IEEE Trans. Acoustics, Speech and Signal Processing*, vol. ASSP–23, Jun. 1975, pp. 309–321.

Y. Linde et al., "An Algorithm for Vector Quantizer Design", *IEEE Transactions on Communications*, vol. Com–28, No. 1, Jan. 1980, pp. 84–95.

Motorola, Inc., "Vector Sum Excited Linear Prediction (VSELP) 7950 Bit per Second Voice Coding Algorithm—Technical Description", Nov. 14, 1989, pp. 9–11.

Y. Shoham, "Cascaded Likelihood Vector Coding of the LPC Information", *Proceedings of the International Conference on Acoustics, Speech, and Signal Processing*, 1989, pp. 160–163.

K. Paliwal et al., "Efficient Vector Quantization of LPC Parameters at 24 Bits/Frame", *Proceedings of the International Conference on Acoustics, Speech and Signal Processing*, 1991, pp. 661–664.

B. Battacharya et al., "Tree Searched Multi–Stage Vector Quanitzation of LPC Parameters for 4kb/s Speech Coding", *Proceedings of the International Conference on Acoustics, Speech and Signal Processing*, Mar. 1992, pp. I–105 to I–108.

T. Parsons, *Voice and Speech Processing*, 1987, pp. 159–161.

*Primary Examiner*—David D. Knepper
*Attorney, Agent, or Firm*—John G. Rauch

[57] ABSTRACT

An input speech signal is encoded as one or more reflection coefficients. To reduce storage requirements, the reflection coefficients are scalar quantized by storing an N-bit code rather than the entire reflection coefficient. An exemplary value for N is 8. A table is provided having $2^N$ reflection coefficient values. The N-bit code is used to look up reflection coefficient values from the table. To reduce spectral distortion due to scalar quantization, the reflection coefficient values in the table are non-linearly scaled.

6 Claims, 3 Drawing Sheets

METHOD OF STORING REFLECTION COEFFIENTS IN A VECTOR QUANTIZER FOR A SPEECH CODER TO PROVIDE REDUCED STORAGE REQUIREMENTS

This is a divisional of Ser. No. 08/037,893 filed Mar. 26, 1993, now abandoned.

FIELD OF THE INVENTION

The present invention generally relates to speech coders using Code Excited Linear Predictive Coding (CELP), Stochastic Coding or Vector Excited Speech Coding and more specifically to vector quantizers for Vector-Sum Excited Linear Predictive Coding (VSELP).

BACKGROUND OF THE INVENTION

Code-excited linear prediction (CELP) is a speech coding technique used to produce high quality synthesized speech. This class of speech coding, also known as vector-excited linear prediction, is used in numerous speech communication and speech synthesis applications. CELP is particularly applicable to digital speech encrypting and digital radiotelephone communications systems wherein speech quality, data rate, size and cost are significant issues.

In a CELP speech coder, the long-term (pitch) and the short-term (formant) predictors which model the characteristics of the input speech signal are incorporated in a set of time varying filters. Specifically, a long-term and a short-term filter may be used. An excitation signal for the filters is chosen from a codebook of stored innovation sequences, or codevectors.

For each frame of speech, an optimum excitation signal is chosen. The speech coder applies an individual codevector to the filters to generate a reconstructed speech signal. The reconstructed speech signal is compared to the original input speech signal, creating an error signal. The error signal is then weighted by passing it through a spectral noise weighting filter. The spectral noise weighting filter has a response based on human auditory perception. The optimum excitation signal is a selected codevector which produces the weighted error signal with the minimum energy for the current frame of speech.

Typically, linear predictive coding (LPC) is used to model the short term signal correlation over a block of samples, also referred to as the short term filter. The short term signal correlation represents the resonance frequencies of the vocal tract. The LPC coefficients are one set of speech model parameters. Other parameter sets may be used to characterize the excitation signal which is applied to the short term predictor filter. These other speech model parameters include: Line Spectral Frequencies (LSF), cepstral coefficients, reflection coefficients, log area ratios, and arc sines.

A speech coder typically vector quantizes the excitation signal to reduce the number of bits necessary to characterize the signal. The LPC coefficients may be transformed into the other previously mentioned parameter sets prior to quantization. The coefficients may be quantized individually (scalar quantization) or they may be quantized as a set (vector quantization). Scalar quantization is not as efficient as vector quantization, however, scalar quantization is less expensive in computational and memory requirements than vector quantization. Vector quantization of LPC parameters is used for applications where coding efficiency is of prime concern.

Multi-segment vector quantization may be used to balance coding efficiency, vector quantizer search complexity, and vector quantizer storage requirements. The first type of multi-segment vector quantization partitions a $N_p$-element LPC parameter vector into n segments. Each of the n segments is vector quantized separately. A second type of multi-segment vector quantization partitions the LPC parameter among n vector codebooks, where each vector codebook spans all $N_p$ vector elements. For illustration of vector quantization assume $N_p$=10 elements and each element is represented by 2 bits. Traditional vector quantization would require $2^{20}$ codevectors of 10 elements each to represent all the possible codevector possibilities. The first type of multi-segment vector quantization with two segments would require $2^{10}+2^{10}$ codevectors of 5 elements each. The second type of multi-segment vector quantization with 2 segments would require $2^{10}+2^{10}$ codevectors of 5 elements each. Each of these methods of vector quantization offering differing benefits in coding efficiency, search complexity and storage requirements. Thus, the speech coder state of the art would benefit from a vector quantizer method and apparatus which increases the coding efficiency or reduces search complexity or storage requirements without changes in the corresponding requirements.

DESCRIPTION OF A PREFERRED EMBODIMENT

A variation on Code Excited Linear Predictive Coding (CELP) called Vector-Sum Excited Linear Predictive Coding (VSELP), described herein, is a preferred embodiment of the present invention. VSELP uses an excitation codebook having a predefined structure, such that the computations required for the codebook search process are significantly reduced. This VSELP speech coder uses a single or multi-segment vector quantizer of the reflection coefficients based on a Fixed-Point-Lattice-Technique (FLAT). Additionally, this speech coder uses a pre-quantizer to reduce the vector codebook search complexity and a high-resolution scalar quantizer to reduce the amount of memory needed to store the reflection coefficient vector codebooks. The result is a high performance vector quantizer of the reflection coefficients, which is also computationally efficient, and has reduced storage requirements.

Figure 1:
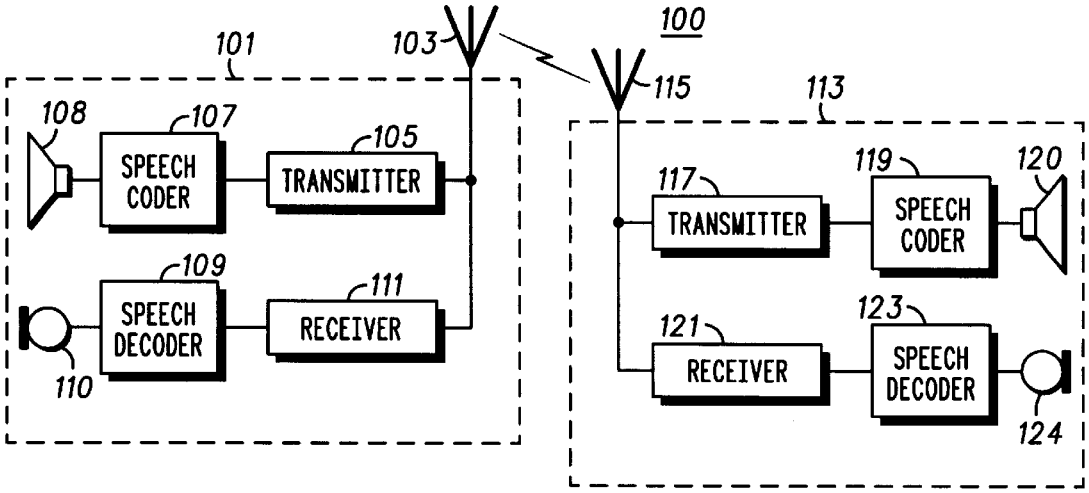
FIG. 1 is a block diagram of a radio communication system including a speech coder in accordance with the present invention.

FIG. 1 is a block diagram of a radio communication system 100. The radio communication system 100 includes two transceivers 101, 113 which transmit and receive speech data to and from each other. The two transceivers 101, 113 may be part of a trunked radio system or a radiotelephone communication system or any other radio communication system which transmits and receives speech data. At the transmitter, the speech signals are input into microphone 108, and the speech coder selects the quantized parameters of the speech model. The codes for the quantized parameters are then transmitted to the other transceiver 113. At the other transceiver 113, the transmitted codes for the quantized parameters are received 121 and used to regenerate the speech in the speech decoder 123. The regenerated speech is output to the speaker 124.

Figure 2:
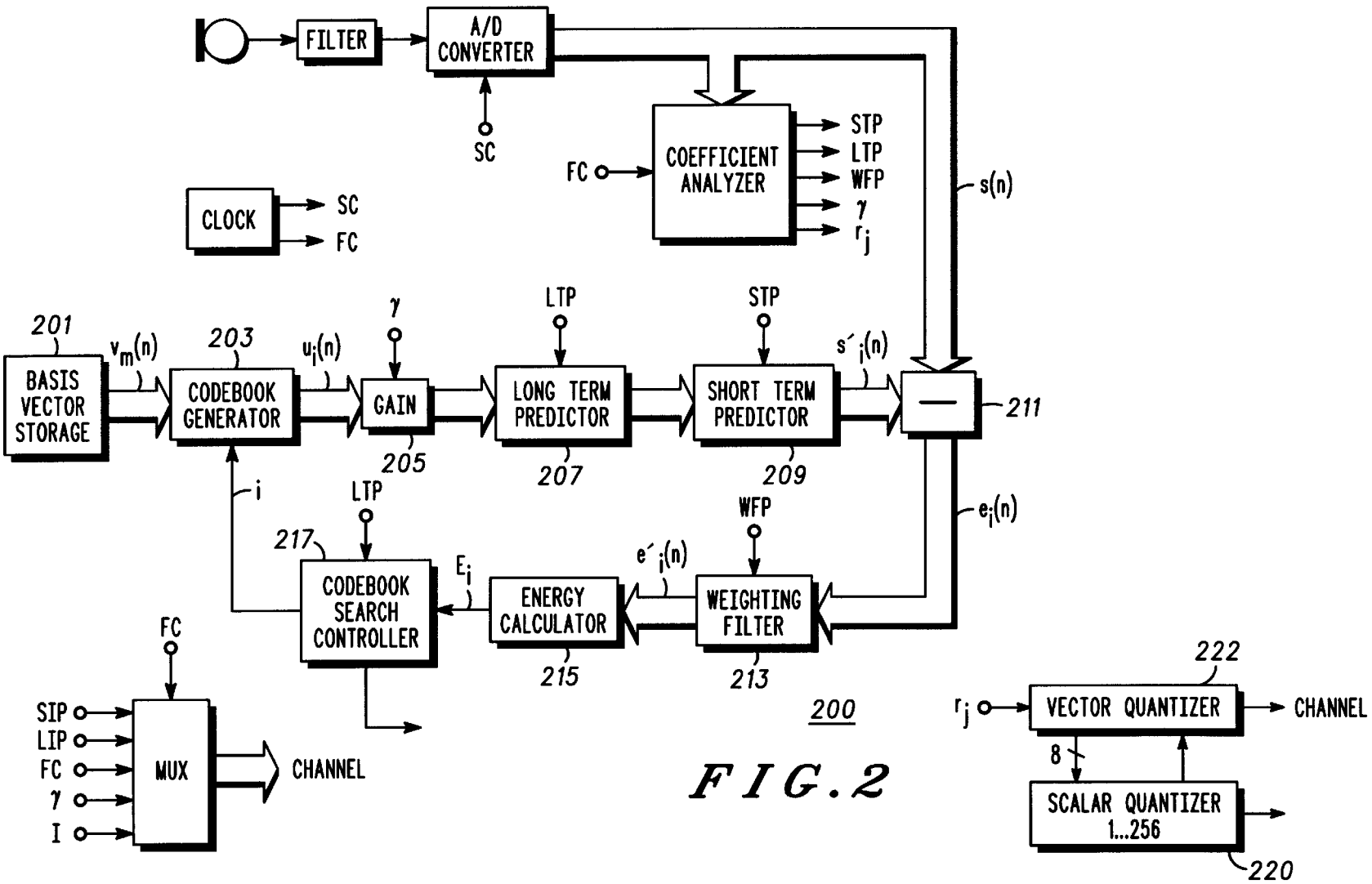
FIG. 2 is a block diagram of a speech coder in accordance with the present invention.

FIG. 2 is a block diagram of a VSELP speech coder 200. A VSELP speech coder 200 uses a received code to determine which excitation vector from the codebook to use. The VSELP coder uses an excitation codebook of $2^M$ codevectors which is constructed from M basis vectors. Defining $v_m(n)$ as the mth basis vector and $u_i(n)$ as the ith codevector in the codebook, then:

$$u_i(n) = \sum_{m=1}^{M} \theta_{im} v_m(n) \tag{1.10}$$

where $0 \leqq i \leqq 2^M-1$; $0 \leqq n \leqq N-1$. In other words, each codevector in the codebook is constructed as a linear combination of the M basis vectors. The linear combinations are defined by the θ parameters. $\theta_i m$ is defined as:

$\theta_i m=+1$ if bit m of codeword i=1

$\theta_i m=-1$ if bit m of codeword i=0 Codevector i is constructed as the sum of the M basis vectors where the sign (plus or minus) of each basis vector is determined by the state of the corresponding bit in codeword i. Note that if we complement all the bits in codeword i, the corresponding codevector is the negative of codevector i. Therefore, for every codevector, its negative is also a codevector in the codebook. These pairs are called complementary codevectors since the corresponding codewords are complements of each other.

After the appropriate vector has been chosen, the gain block 205 scales the chosen vector by the gain term, γ. The output of the gain block 205 is applied to a set of linear filters 207, 209 to obtain N samples of reconstructed speech. The filters include a "long-term" (or "pitch") filter 207 which inserts pitch periodicity into the excitation. The output of the "long-term" filter 207 is then applied to the "short-term" (or "formant") filter 209. The short term filter 209 adds the spectral envelope to the signal.

The long-term filter 207 incorporates a long-term predictor coefficient (LTP). The long-term filter 207 attempts to predict the next output sample from one or more samples in the distant past. If only one past sample is used in the predictor, than the predictor is a single-tap predictor. Typically one to three taps are used. The transfer finction for a long-term ("pitch") filter 207 incorporating a single-tap long-term predictor is given by (1.1).

$$B(z) = \frac{1}{1 - Bz^{-L}} \tag{1.1}$$

B(z) is characterized by two quantities L and β. L is called the "lag". For voiced speech, L would typically be the pitch period or a multiple of it. L may also be a non integer value. If L is a non integer, an interpolating finite impulse response (FIR) filter is used to generate the fractionally delayed samples. β is the long-term (or "pitch") predictor coefficient.

The short-term filter 209 incorporates short-term predictor coefficients, $\alpha_i$, which attempt to predict the next output sample from the preceding Np output samples. Np typically ranges from 8 to 12. In the preferred embodiment, Np is equal to 10. The short-term filter 209 is equivalent to the traditional LPC synthesis filter. The transfer function for the short-term filter 209 is given by (1.2).

$$A(z) = \frac{1}{1 - \sum_{i=1}^{N_p} \alpha_i z^{-i}} \tag{1.2}$$

The short-term filter 209 is characterized by the $\alpha_i$ parameters, which are the direct form filter coefficients for the all-pole "synthesis" filter. Details concerning the $\alpha_i$ parameters can be found below.

The various parameters (code, gain, filter parameters) are not all transmitted at the same rate to the synthesizer (speech decoder). Typically the short term parameters are updated less often than the code. We will define the short term parameter update rate as the "frame rate" and the interval between updates as a "frame". The code update rate is determined by the vector length, N. We will define the code update rate as the "subframe rate" and the code update interval as a "subframe". A frame is usually composed of an integral number of subframes. The gain and long-term parameters may be updated at either the subframe rate, the frame rate or some rate in between depending on the speech coder design.

The codebook search procedure consists of trying each codevector as a possible excitation for the CELP synthesizer. The synthesized speech, s'(n), is compared 211 against the input speech, s(n), and a difference signal, $e_i$, is generated. This difference signal, $e_i(n)$, is then filtered by a spectral weighting filter, W(z) 213, (and possibly a second weighting filter, C(z)) to generate a weighted error signal, e'(n). The power in e'(n) is computed at the energy calculator 215. The codevector which generates the minimum weighted error power is chosen as the codevector for that subframe. The spectral weighting filter 213 serves to weight the error spectrum based on perceptual considerations. This weighting filter 213 is a function of the speech spectrum and can be expressed in terms of the α parameters of the short term (spectral) filter 209.

$$W(z) = \frac{1 - \sum_{i=1}^{N_p} \alpha_i z^{-i}}{1 - \sum_{i=1}^{N_p} \tilde{\alpha}_i z^{-i}} \tag{1.3}$$

There are two approaches that can be used for calculating the gain, γ. The gain can be determined prior to codebook search based on residual energy. This gain would then be fixed for the codebook search. Another approach is to optimize the gain for each codevector during the codebook search. The codevector which yields the minimum weighted error would be chosen and its corresponding optimal gain would be used for γ. The latter approach generally yields better results since the gain is optimized for each codevector. This approach also implies that the gain term must be updated at the subframe rate. The optimal code and gain for this technique can be computed as follows:

1. Compute y(n), the weighted input signal, for the subframe.
2. Compute d(n); the zero-input response of the B(z) and W(z) (and C(z) if used) filters for the subframe. (Zero input response is the response of the filters with no input; the decay of the filter states.)
3. p(n)=y(n)−d(n) over subframe ($0 \leqq n \leqq N-1$)
4. for each code i
   a. Compute $g_i(n)$, the zero state response of B(z) and W(z) (and C(z) if used) to codevector i. (Zero-state response is the filter output with initial filter states set to zero.)
   b. Compute $$C_i = \sum_{n=0}^{N-1} g_i(n)p(n) \tag{1.5}$$

the cross correlation between the filtered codevector i and p(n)

c. Compute $$G_i = \sum_{n=0}^{N-1} \{g_i(n)\}^2 \tag{1.6}$$

the power in the filtered codevector i.

$$\frac{(C_i)^2}{G_i} \tag{1.7}$$

5. Choose i which maximizes
6. Update filter states of B(z) and W(z) (and C(z) if used) filters using chosen codeword and its corresponding quantized gain. This is done to obtain the same filter states that the synthesizer would have at the start of the next subframe for step 2.

The optimal gain for codevector i is given by (1.8)

$$\gamma_i = \frac{C_i}{G_i} \tag{1.8}$$

And the total weighted error for codevector i using the optimal gain, $\gamma_i$ is given by (1.9).

$$E_i = \left( \sum_{n=0}^{N-1} p^2(n) \right) \cdot \frac{(C_i)^2}{G_i} \ . \tag{1.9}$$

The short term predictor parameters are the $\alpha_i$'s of the short term filter 209 of FIG. 2. These are standard LPC direct form filter coefficients and any number of LPC analysis techniques can be used to determine these coefficients. In the preferred embodiment, a fast fixed point covariance lattice algorithm (FLAT) was implemented. FLAT has all the advantages of lattice algorithms including guaranteed filter stability, non-windowed analysis, and the ability to quantize the reflection coefficients within the recursion. In addition FLAT is numerically robust and can be implemented on a fixed-point processor easily.

The short term predictor parameters are computed from the input speech. No pre-emphasis is used. The analysis length used for computation of the parameters is 170 samples ($N_A$=170). The order of the predictor is 10 ($N_P$=10).

This section will describe the details of the FLAT algorithm. Let the samples of the input speech which fall in the analysis interval be represented by s(n); $0 \leqq n \leqq N_A-1$. Since FLAT is a lattice algorithm one can view the technique as trying to build an optimum (that which minimizes residual energy) inverse lattice filter stage by stage.

Defining $b_j(n)$ to be the backward residual out of stage j of the inverse lattice filter and fj(n) to be the forward residual out of stage j of the inverse lattice filter we can define:

$$F_j(i,k) = \sum_{n=N_p}^{N_A-1} f_j(n-1)f_j(n-k) \tag{2.1}$$

the autocorrelation of fj(n);

$$B_j(i,k) = \sum_{n=N_p}^{N_A-1} b_j(n-i-1)b_j(n-k-1) \tag{2.2}$$

the autocorrelation of bj(n−1) and:

$$C_j(i,k) = \sum_{n=N_p}^{N_A-1} f_j(n-1)b_j(n-k-1) \tag{2.3}$$

the cross correlation between fj(n) and bj(n−1). Let rj represent the reflection coefficient for stage j of the inverse lattice. Then:

$$F_j(i,k)=F_{j-1}(i,k)+r_j(C_{j-1}(i,k)+C_{j-1}(k,i)+r_j^2B_{j-1}(i,k) \tag{2.4}$$

and $$B_j(i,k)=B_{j-1}(i+1,k+1)+r_j(C_{j-1}(i+1,k+1)+C_{j-1}(k+1,i+1))+r_j^2F_{j-1}(i+1,+k1) \tag{2.5}$$

and $$C_j(i,k)=C_{j-1}(i,k+1)+r_j(B_{j-1}(i,k+1)+F_{j-1}(i,k+1))+r_j^2C_{j-1}(k+1,i) \tag{2.6}$$

The formulation we have chosen for the determination of rj can be expressed as:

$$r_j = -2\frac{C_{j-1}(0,0) + C_{j-1}(N_P-j,N_P-j)}{F_{j-1}(0,0) + B_{j-1}(0,0) + F_{j-1}(N_P-j,N_P-j) + B_{j-1}(N_P-j,N_P-j)}$$

The FLAT algorithm can now be stated as follows,

1. First compute the covariance (autocorrelation) matrix from the input speech:

$$\phi(i,k) = \sum_{N_P}^{N_A-1} s(n-i)s(n-k) \tag{2.8}$$

for $0 \leqq i,k \leqq NP$.

2. F0(i,k)=f(i,k) $0 \leqq i,k \leqq NP-1$ (2.9)

$$B0(i,k)=f(i+1,k+1) 0 \leqq i,k \leqq NP-1 \tag{2.10}$$

$$C0(i,k)=f(i,k+1) 0 \leqq i,k \leqq NP-1 \tag{2.11}$$

3. setj=1
4. Compute rj using (2.7)
5. If j=NP then done.
6. Compute Fj(i,k) $0 \leqq i,k \leqq NP-j-1$ using (2.4)
   Compute Bj(i,k) $0 \leqq i,k \leqq NP-j-1$ using (2.5)
   Compute Cj(i,k) $0 \leqq i,k \leqq NP-j-1$ using (2.6)
7. j=j+1; go to 4.

Prior to solving for the reflection coefficients, the $\phi$ array is modified by windowing the autocorrelation functions.

$$\phi'(i,k)=\phi(i,k)w(|i-k|) \tag{2.12}$$

Windowing of the autocorrelation function prior to reflection coefficient computation is known as spectral smoothing (SST).

From the reflection coefficients, rj, the short term LPC predictor coefficients, $\alpha_i$, may be computed.

A 28-bit three segment vector quantizer 222 (FIG. 2) of the reflection coefficients is employed. The segments of the vector quantizer span reflection coefficients r1–r3, r4–r6, and r7–r10 respectively. The bit allocations for the vector quantizer segments are;

Q1 11 bits
Q2 9 bits
Q3 8 bits.

To avoid the computational complexity of an exhaustive vector quantizer search, a reflection coefficient vector prequantizer is used at each segment. The prequantizer size at each segment is:

P1 6 bits
P2 5 bits
P3 4 bits

At a given segment, the residual error due to each vector from the prequantizer is computed and stored in temporary memory. This list is searched to identify the four prequantizer vectors which have the lowest distortion. The index of each selected prequantizer vector is used to calculate an offset into the vector quantizer table at which the contiguous subset of quantizer vectors associated with that prequantizer vector begins. The size of each vector quantizer subset at the k-th segment is given by:

$$S_k = \frac{2^{Q_k}}{2^{P_k}} \tag{2.13}$$

The four subsets of quantizer vectors, associated with the selected prequantizer vectors, are searched for the quantizer vector which yields the lowest residual error. Thus at the first segment 64 prequantizer vectors and 128 quantizer vectors are evaluated, 32 prequantizer vectors and 64 quantizer vectors are evaluated at the second segment, and 16 prequantizer vectors and 64 quantizer vectors are evaluated at the third segment. The optimal reflection coefficients, computed via the FLAT technique with bandwidth expansion as previously described are converted to an autocorrelation vector prior to vector quantization.

An autocorrelation version of the FLAT algorithm, AFLAT, is used to compute the residual error energy for a reflection coefficient vector being evaluated. Like FLAT, this algorithm has the ability to partially compensate for the reflection coefficient quantization error from the previous lattice stages, when computing optimal reflection coefficients or selecting a reflection coefficient vector from a vector quantizer at the current segment. This improvement can be significant for frames that have high reflection coefficient quantization distortion. The AFLAT algorithm, in the context of multi-segment vector quantization with prequantizers, is now described:

Compute the autocorrelation sequence R(i), from the optimal reflection coefficients, over the range $0 \leqq i \leqq Np$. Alternatively, the autocorrelation sequence may be computed from other LPC parameter representations, such as the direct form LPC predictor coefficients, $\alpha_i$, or directly from the input speech.

Define the initial conditions for the AFLAT recursion:

$$\overline{P}_0(i)=R(i),\ 0 \leqq \leqq N_p-1 \tag{2.14}$$

$$\overline{V}_0(i)=R(|i+1|),\ 1-N_p \leqq i \leqq N_p-1 \tag{2.5}$$

Initialize k, the vector quantizer segment index;

$$k=1 \tag{2.16}$$

Let Ij(k) be the index of the first lattice stage in the k-th segment, and $I_h(k)$ be the index of the last lattice stage in the k-th segment. The recursion for evaluating the residual error out of lattice stage $I_h(k)$ at the k-th segment, given r̂, a reflection coefficient vector from the prequantizer or the reflection coefficient vector from the quantizer is given below.

Initialize j, the index of the lattice stage, to point to the beginning of the k-th segment:

$$j=I_j(k) \tag{2.17}$$

Set the initial conditions Pj−1 and Vj−1 to:

$$P_{j-1}(i)=\overline{P}_{j-1}(i),\ 0 \leqq i \leqq I_h(k)-I_1(k)+1 \tag{2.18}$$

$$V_{j-1}(i)=\overline{V}_{j-1}(i),\ -I_h(k)+I_1(k)-1 \leqq i \leqq I_h(k)-I_1(k)+1 \tag{2.19}$$

Compute the values of Vj and Pj arrays using:

$$P_j(i)=(1+\hat{r}_j^2)P_{j-1}(i)+\hat{r}_j[V_{j-1}(i)+V_{j-1}(-i)],\ 0 \leqq i \leqq I_h(k)-j \tag{2.20}$$

$$V_j(i)=V_{j-1}(i+1)+\hat{r}_j^2V_{j-1}(-i-1)+2\hat{r}_jP_{j-1}(|i+1|),\ j-I_h(k) \leqq i \leqq I_h(k)-j \tag{2.21}$$

Increment j:

$$j=j+1 \tag{2.22}$$

If $j \leqq I_h(k)$ go to (2.20).

The residual error out of lattice stage $I_h(k)$, given the reflection coefficient vector r̂, is given by:

$$E_r=P_{I_h(k)}(0) \tag{2.23}$$

Using the AFLAT recursion outlined, the residual error due to each vector from the prequantizer at the k-th segment is evaluated, the four subsets of quantizer vectors to search are identified, and residual error due to each quantizer vector from the selected four subsets is computed. The index of r̂, the quantizer vector which minimized $E_r$ over all the quantizer vectors in the four subsets, is encoded with $Q_k$ bits.

If k<3 then the initial conditions for doing the recursion at segment k+1 need to be computed. Set j, the lattice stage index, equal to:

$$j=I_1(k) \tag{2.24}$$

Compute:

$$\overline{P}_j(i)=(1+\hat{r}_j^2)\overline{P}_{j-1}(i)+\hat{r}_j[\overline{V}_{j-1}(i)+\overline{V}_{j-1}(-i)],\ 0 \leqq i \leqq N_p-j-1 \tag{2.25}$$

$$\overline{V}_j(i)=\overline{V}_{j-1}(i+1)+\hat{r}_j^2\overline{V}_{j-1}(-i-1)+2\hat{r}_j\overline{P}_{j-1}(|i+1|),\ j-N_p+1 \leqq i \leqq N_p-j-1 \tag{2.26}$$

Increment j, $$j=j+1 \tag{2.27}$$

If $j \leqq I_h(k)$ go to (2.25).

Increment k, the vector quantizer segment index:

$$k=k+1 \tag{2.28}$$

If $k \leqq 3$ go to (2.17). Otherwise, the indices of the reflection coefficient vectors for the three segments have been chosen, and the search of the reflection coefficient vector quantizer is terminated.

Figure 3:
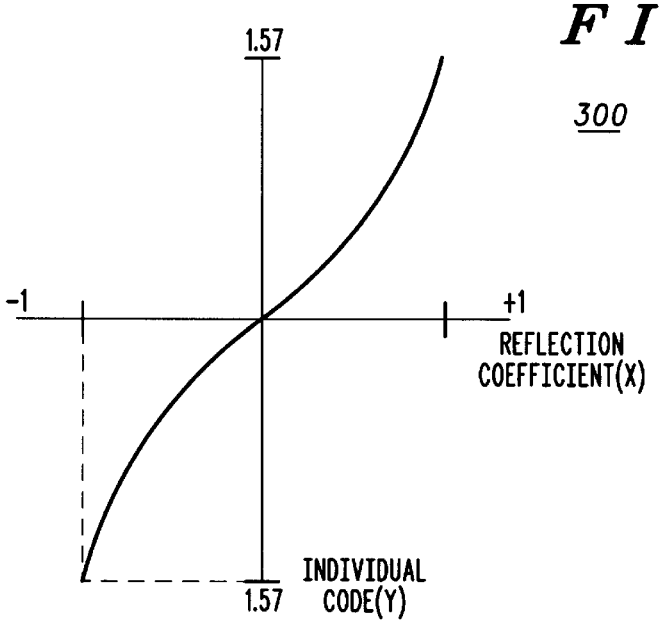
FIG. 3 is a graph of the arcsine function used in accordance with the present invention.

To minimize the storage requirements for the reflection coefficient vector quantizer 222 (FIG. 2), eight bit codes for the individual reflection coefficients are stored in the vector quantizer table, instead of the actual reflection coefficient values. The codes are used to look up the values of the resection coefficients from a scalar quantization table 220 with 256 entries. The eight bit codes represent reflection coefficient values obtained by uniformly sampling an arcsine function illustrated in FIG. 3. Reflection coefficient values vary from −1 to +1. The non-linear spacing in the reflection coefficient domain (X axis) provides more precision for reflection coefficients when the values are near the extremes of ±1 and less precision when the values are near 0. This reduces the spectral distortion due to scalar quantization of the reflection coefficients, given 256 quantization levels, as compared to uniform sampling in the reflection coefficient domain.

Figure 4:
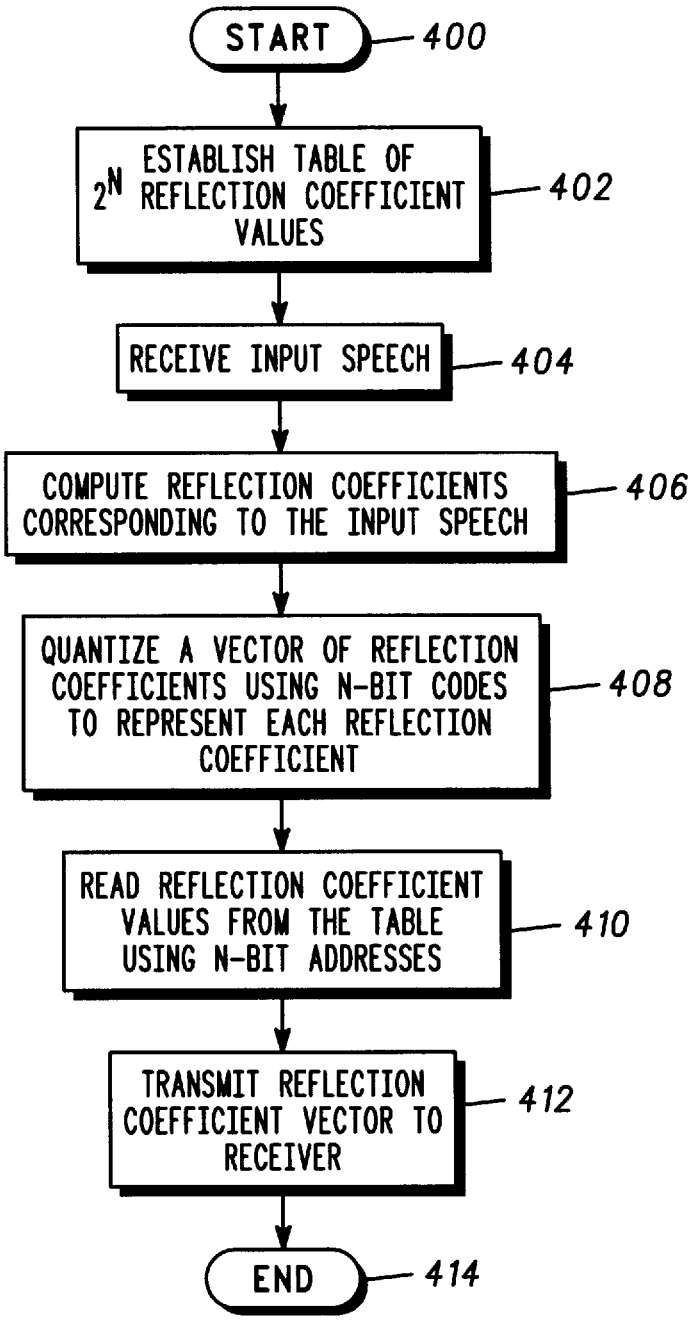
FIG. 4 is a flow diagram illustrating a method in accordance with the present invention.

FIG. 4 is a flow diagram illustrating a method in accordance with the present invention. The method begins at step 400. At step 402, a table of $2^N$ reflection coefficient values is established. This corresponds to the scalar quantization table 220 of FIG. 2. At 404, input speech is received and processed. At step 406, reflection coefficients are computed corresponding to the input speech, for example using the FLAT algorithm described above. At step 408, the computed reflection coefficients are vector quantized at the vector quantizer 222 (FIG. 2). To reduce storage requirements for the vector quantizer 222, eight bit codes for the individual reflection coefficients are stored in the vector quantizer table, instead of the actual reflection coefficient values. The codes are used to look up the values of the reflection coefficients from the scalar quantization table 220, step 410. The reflection coefficient vector is then transmitted, along with other speech coding parameters, to the receiver, step 412. The method ends at step 414.

What is claimed is:

1. A speech coding method comprising the steps of:

(a) constructing an excitation codebook of $2^M$ codevectors using M basis vectors;

(b) receiving input speech;

(c) in response to the input speech, computing reflection coefficient values corresponding to speech parameters representative of the input speech;

(d) storing in a table $2^N$ reflection coefficient values, each reflection coefficient value addressable with an N-bit code;

(e) processing codevectors to produce synthesized speech;

(f) selecting a codevector from the excitation codebook which minimizes an error criterion for the synthesized speech relative to the input speech, including (f1) when reflection coefficient values are required for processing, providing corresponding N-bit codes to the table to look up the reflection coefficient values, (f2) otherwise storing only the N-bit codes during processing, thereby minimizing storage requirement for the reflection coefficient values.

2. A method of storing reflection coefficient vectors in a vector quantizer for a speech coder in accordance with claim 1 wherein the reflection coefficient values are non-linearly scaled.

3. A method of storing reflection coefficient vectors in a vector quantizer for a speech coder in accordance with claim 1 wherein the reflection coefficient values are arcsine scaled between the values of −1 and +1.

4. A method of storing reflection coefficient vectors in a vector quantizer for a speech coder in accordance with claim 1 where N equals 8.

5. A speech coder comprising:

a codebook generator which generates an excitation codebook having $2^M$ codevectors formed using M basis vectors;

input means for receiving an input speech signal and producing a data vector;

coding means coupled to the input means for generating reflection coefficients corresponding to speech parameters representative of the input speech signal, the coding means processing the codevectors to produce synthesized speech;

a vector quantizer for quantizing the reflection coefficients, the vector quantizer including a vector quantizer memory configured to store $2^N$ reflection coefficient values, the vector quantizer memory having a N-bit input and an output, the vector quantizer memory providing one of the $2^N$ reflection coefficient values at the output in response to an N-bit address received at the N-bit input; and a codebook search controller coupled to the codebook generator which selects a codevector from the excitation codebook to minimize an error criterion between the synthesized speech and the data vector, the codebook search controller being coupled to the vector quantizer and providing a corresponding N-bit code to the vector quantizer to look up a reflection coefficient value for processing, the codebook search controller otherwise storing only the N-bit code to thereby minimize storage requirements.

6. A speech coder as recited in claim 5 wherein each reflection coefficient value is related to an associated N-bit address by an arcsine scaling function.

* * * * *